US007312423B2

(12) United States Patent
Idomoto et al.

(10) Patent No.: US 7,312,423 B2
(45) Date of Patent: Dec. 25, 2007

(54) COOKING DEVICE

(75) Inventors: Susumu Idomoto, Yamatokoriyama (JP); Tomotaka Nobue, Yamatokoriyama (JP); Koji Yoshino, Yamatokoriyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 200 days.

(21) Appl. No.: 10/539,422

(22) PCT Filed: Feb. 5, 2004

(86) PCT No.: PCT/JP2004/001198

§ 371 (c)(1),
(2), (4) Date: Jun. 20, 2005

(87) PCT Pub. No.: WO2004/070276

PCT Pub. Date: Aug. 19, 2004

(65) Prior Publication Data

US 2006/0070615 A1 Apr. 6, 2006

(30) Foreign Application Priority Data

Feb. 5, 2003 (JP) ..... 2003-028390

(51) Int. Cl.

| | |
|---|---|
| ***A21B 1/14*** | (2006.01) |
| ***A21B 1/22*** | (2006.01) |
| ***A47J 37/00*** | (2006.01) |
| ***F27D 11/02*** | (2006.01) |

(52) U.S. Cl. ..... 219/402; 219/405; 219/411

(58) Field of Classification Search ..... None
See application file for complete search history.

(56) References Cited

U.S. PATENT DOCUMENTS

| | | | | |
|---|---|---|---|---|
| 3,693,538 | A * | 9/1972 | Synder | 219/405 |
| 4,761,529 | A * | 8/1988 | Tsisios | 219/685 |
| 5,471,914 | A * | 12/1995 | Krasznai et al. | 219/405 |
| 5,782,230 | A * | 7/1998 | Linnebur et al. | 126/41 R |
| 6,337,466 | B1 * | 1/2002 | Chasen | 219/405 |

FOREIGN PATENT DOCUMENTS

| | | |
|---|---|---|
| JP | 61-34709 | 10/1986 |
| JP | 3-191211 | 8/1991 |
| JP | 7-27345 | 1/1995 |
| JP | 11-159770 | 6/1999 |
| JP | 2001-74249 A * | 3/2001 |

OTHER PUBLICATIONS

Microfilm of the specification and drawings annexed to the request of JP Utility Model Application No. 140482/1989 (Laid-open No. 80205/1992), Matsushita Electric Industrial Co., Aug. 16, 1991.

* cited by examiner

*Primary Examiner*—Joseph Pelham
(74) *Attorney, Agent, or Firm*—Pearne & Gordon LLP

(57) ABSTRACT

A heating cooker (100) for heating to process an object placed on a mounting base of a heating chamber (51) including at least a single piece of a rod-like heater arranged along a face member forming the heating chamber (51) and a heat shielding member provided along a longitudinal direction of the rod-like heater between the rod-like heater and the face member (53*a*) on an outer side of the heating chamber (51).

17 Claims, 12 Drawing Sheets

COOKING DEVICE

TECHNICAL FIELD

The present invention relates to a heating cooker for heating to process an object to be heated placed on a mounting base at inside of a heating chamber, particularly relates to an improvement technology for correcting unevenness in a temperature distribution when a single piece of a rod-like heater is used to thereby make a heating temperature distribution of a heating chamber uniform.

BACKGROUND ART

In a background art, there is a heating cooker for heating to cook a heating object capable of carrying out high frequency heating and heater heating. According to a heating cooker of this kind, although convenience can be promoted since the heating cooker is provided with two functions of high frequency heating and heater heating, at the same time, there is a disadvantage of increasing fabrication cost by increasing a number of constituent parts. Hence, it is necessary to devise to enable to carry out excellent heating cooking by being constituted by a small number of parts. For example, in the case of cooking by heater heating, even when single pieces of rod-like heaters are provided at an upper portion and a lower portion of a heating chamber, an object needs to be heated uniformly.

There is background reference information related to the invention of the application as follows.

(Patent Reference 1) JP-A-11-159770

As shown by FIG. 12, a heating cooker 1 disclosed in Patent Reference 1, mentioned above, is provided with quartz tube heaters 7 and 9 arranged at an upper portion and a lower portion of a heating chamber rearward from a rotating shaft 5 of a turn table at inside of the heating chamber 3, and a toast net 15 having a leg portion 13 mounted on a flat bottom plate 11 of a heating chamber 3, and a toast net 15 having a leg portion 13 mounted on a flat bottom plate 11 of the heating chamber 3, and when the toast net 15 is contained on a rear side of the heating chamber 3 by making a left and right direction of the heating chamber 3 in parallel with a long side of the toast net 15, a length of a short side of the toast net 15 is constituted by a length by which an object to be heated (bread for toasting) 17 can be set to a position capable of being heated uniformly by the quartz tube heaters 7, 9.

Therefore, according to the above-described hearting cooker 1, it can be expected that a baked mark of the toast always stays substantially the same by maintaining distances between the quartz tube heaters 7, 9 and the bread 17 constant.

However, according to the above-described heating cooker of the background art, the length of the short side of the toast net 15 is the length adjusted such that positions of the quartz tube heaters 7 and 9 can be disposed substantially at a center of the bread 17 when a frame wire member 19 is brought into contact with a rear plate 21 which is face member of the heating chamber 3 and therefore, although the distances between the respective heaters 7, 9 and the bread 17 can always be made constant, since the heater in the rod-like shape traverses the center portion of the bread 17 in a left and right direction thereof, heat is concentrated on the center portion of the bread right above the heater. Therefore, a heating temperature distribution in a depth direction of the heating chamber does not become uniform and there is a case in which whereas the center portion of the object is excessively heated, heat becomes deficient at a front edge portion and a rear edge portion of the object and a baked mark is not produced uniformly over a total of the object.

In a heating cooker having a structure in which, for example, the bottom plate 11 is not provided and the object is directly heated by the lower heater in order to resolve a drawback of this kind, there is known a heating cooker in which a round bar having a diameter of about 3 through 4 mm is interposed between the lower heater and the object along the heater to restrain heat of the lower heater from being transferred directly to the object. However, according to structure of using the round bar for such an interposed member, a heat capacitance of the round bar per se is large and therefore, heat is deprived by the round bar per se, an effect of effectively widening the heat from the heater is not achieved, and actually, the object cannot uniformly be baked.

The invention has been carried out in view of the above-described situation to provide a heating cooker capable of producing a uniform baked mark at a total of an object at inexpensive cost by a single piece of a rod-like heater in a heating cooker interposing a face member between the object and the rod-like heater.

DISCLOSURE OF INVENTION

A heating cooker described in Claim 1 according to the invention for achieving the above-described object is characterized in a heating cooker for heating to process an object placed on a mounting base at inside of a heating chamber, the heating cooker comprising at least a single piece of a rod-like heater arranged along a face member forming the heating chamber on an outer side of the heating chamber, and a heat shielding member provided along a longitudinal direction of the rod-like heater between the rod-like heater and the face member.

According to the heating cooker, heat transferred from the rod-like heater to a portion proximate to the face member on the outer side of the heating chamber can pertinently be restrained by the heat shielding member and the face member can uniformly be heated. That is, according to the heating cooker, the face member is temporarily heated by heat of the rod-like heater and the object is secondarily heated by the heated face member. Therefore, in the heating chamber arranged with the rod-like heater such that, for example, a longitudinal direction of the rod-like heater coincides with an opening direction, a heating temperature distribution in a depth direction is made to be uniform and a center portion of the object which is liable to be heated excessively and a front end portion and a rear end portion of the object which are liable to be heated insufficiently in the background art are equally heated.

The heating cooker described in Claim 2 is the heating cooker described in Claim 1, characterized in that the heat shielding member comprises a flat plate material.

According to the heating cooker, the heat shielding member comprises the flat plate material and therefore, a heat capacitance thereof is made to be smaller than that of the heat shielding member comprising the round bar. Thereby, heat deprived by the heat shielding member per se is reduced, a larger effect of dispersing heat is achieved, and the heating temperature distribution in the depth direction of the heating chamber is made to be further uniform.

The heating cooker described in Claim 3 is the heating cooker described in Claim 1, characterized in that the heat shielding member is constituted by folding to bend a flat plate material and is provided with a section in a projected shape projected to the rod-like heater.

According to the heating cooker, by constituting the section of the heat shielding member arranged right above the rod-like heater by the projected shape (for example, section in V-like shape) projected to the rod-like heater, a heating air flow moved up from the rod-like heater is divided in two from a front end of the projected portion and distributed to a front side and a rear side in a depth direction of the heating chamber to promote an effect of heating a front side of the face member and a rear side of the face member. Further, radiation heat from the rod-like heater can be reflected to a lower front side and a lower rear side of the rod-like heater by a pair of inclined faces interposing the front end of the projected portions of the heat shielding member. Therefore, according to a constitution of providing a reflecting plate having a section in a V-like shape on a lower side of the rod-like heater, the reflected radiation heat is further irradiated to the front side of the face member and the rear side of the face member via the reflecting plate to promote the effect of heating the front side of the member and the rear side of the member.

The heating cooker described in Claim 4 is the heating cooker described in Claim 2 or Claim 3 characterized in that a heat shielding area of the heat shielding member is set to be large at a center portion in a longitudinal direction of the heat shielding member and to be small an end portion in the longitudinal direction.

According to the heating cooker, the heat shielding area of the heat shielding member is made to be large at the center portion in the longitudinal direction of the rod-like heater, the heat shielding area of the heat shielding member is made to be small at the end portion in the longitudinal direction of the rod-like heater and heat transferred from the rod-like heater to the face member is made to be uniform in the longitudinal direction of the rod-like heater. Therefore, in the heating chamber arranged such that the longitudinal direction of the rod-like heater coincides with the opening direction, the heating temperature distribution in the opening direction is made to be uniform and the center portion of the object which is liable to be heated excessively and the left end portion and the right end portion of the object which are liable to be heated insufficiently in the background art are equally heated.

The heating cooker described in Claim 5 is the heating cooker described in Claim 4 characterized in that the heat shielding member includes an opening hole and the heat shielding area is set by large or small of an opening area of the opening hole.

According to the heating cooker, the heat shielding area is set by the opening hole formed at the heat shielding member and the heat shielding area can be adjusted regardless of a shape of the heat shielding area (for example, width of heat shielding member). Thereby, a degree of freedom of designing the heat shielding member having the reflecting function and the heat shielding function is promoted. Further, large or small of the opening area includes large or small by adjusting a size of the single opening hole, large or small by adjusting to increase or reduce a plurality of the opening holes, or large or small by adjusting a pitch interval of the plurality of opening holes and so on.

The heating cooker described in Claim 6 is the heating cooker described in Claim 4 or Claim 5, characterized in that a width of the heat shielding member in a direction orthogonal to the longitudinal direction is changed along the longitudinal direction to thereby set the heat shielding area.

According to the heating cooker, the heat shielding area is set by changing the width of the heat shielding member. That is, the width dimension is set to be large at the center portion of the rod-like heater intended to ensure a large shielding area and the width dimension is set to be small at the end portion of the rod-like heater intended to reduce the shielding area. Thereby, the heat shielding area can be controlled by a simple shape of the heat shielding member.

The heating cooker described in Claim 7 is the heating cooker described in Claim 6 characterized in that the width of the heat shielding member in the direction orthogonal to the longitudinal direction is provided with a width substantially equal to at least a diameter of the rod-like heater.

According to the heating cooker, the width of the heat shielding member is provided with the width substantially equal to at least the diameter of the rod-like heater to thereby shield direct radiation from the rod-like heater to the face member.

The heating cooker described in Claim 8 is the heating cooker described in any one of Claim 1 through Claim 7 characterized in that the face member of the heating chamber opposed to the rod-like heater is provided with at least either one of a recessed portion having a section in a recessed shape or a projected portion having a section in a projected shape formed substantially in parallel with the longitudinal direction of the rod-like heater along therewith.

According to the heating cooker, the face member opposed to the rod-like heater is formed with the recessed portion or the projected portion substantially in parallel with the longitudinal direction of the rod-like heater along therewith and a distance adjusting operation (effect of adjusting an amount of heat received by the face member by the distance between the face member and the heater) or the like which is not achieved in the case of a flat face member is achieved.

The heating cooker described in Claim 9 is the heating cooker described in Claim 8 characterized in that the face member of the heating chamber includes a pair of the projected portions on both sides interposing the rod-like heater.

According to the heating cooker, the face member is formed with a pair of the projected portions and the projected portion is made to be proximate to the object at inside of the heating chamber and constitutes a recess outside of the heating chamber. Therefore, heating of the front side and the rear in the depth direction of the heating chamber is promoted at inside of the heating chamber by the distance adjusting operation or the like.

The heating cooker described in Claim 10 is the heating cooker described in Claim 8 or Claim 9 characterized in that the face member of the heating chamber includes the recessed portion opposed to the rod-like heater.

According to the heating cooker, the recessed portion is formed at the portion of the face member opposed to the rod-like heater and the recessed portion becomes remote from the object at inside of the heating chamber. Therefore, heating of the center portion in the depth direction of the heating chamber is restrained and transfer of heat from the rod-like heater is reduced by the distance adjusting operation at inside of the heating chamber.

Figure 1:
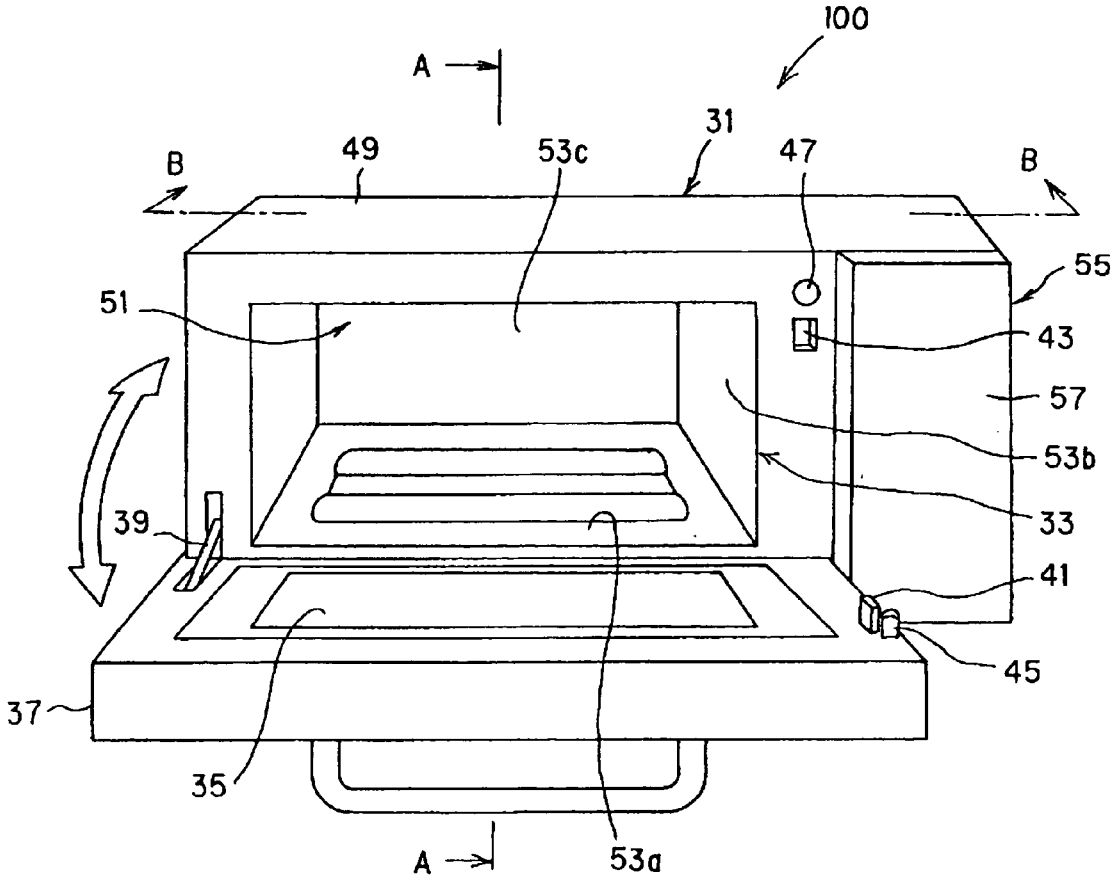
FIG. 1 is a perspective view viewing a state of opening a door of a heating cooker according to the invention from a front side.

Further, in the drawings, notation 51 designates a heating chamber, 53 designates a face member, 53*a* designates a bottom plate (face member), 53*b* designates a side plate (face member), 53*c* designates a rear plate (face member), 53*d* designates a ceiling plate (face member), 65, 81 designate rod-like heaters, 73 designates a mounting base, 83 designates a heat shielding member, 87 designates an opening hole, 93 designates a recessed portion, 95 designates a projected portion, 100 designates a heating cooker, and 101 designates an object.

BEST MODE FOR CARRYING OUT THE INVENTION

A detail explanation will be given of preferable embodiments of a heating cooker according to the invention in reference to the drawings as follows.

Figure 2:
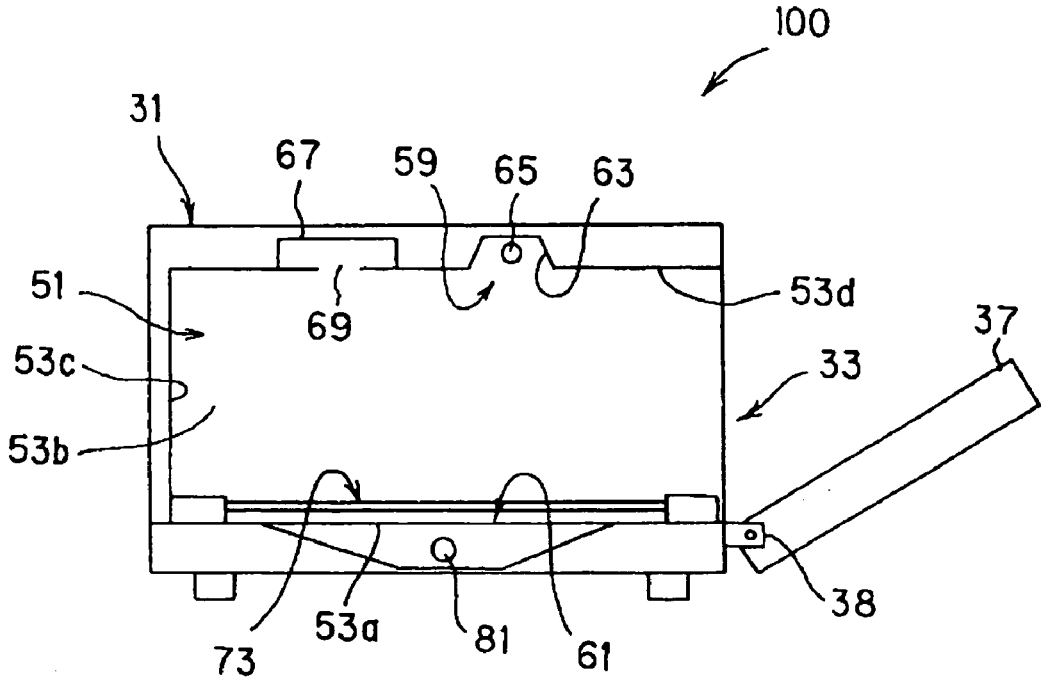
FIG. 2 illustrates explanatory views of an inner structure in which FIG. 2(*a*) is a view taken along a line A-A of the heating cooker shown in FIG. 1 and FIG. 2(*b*) is a view taken along a line B-B thereof.
Figure 2:
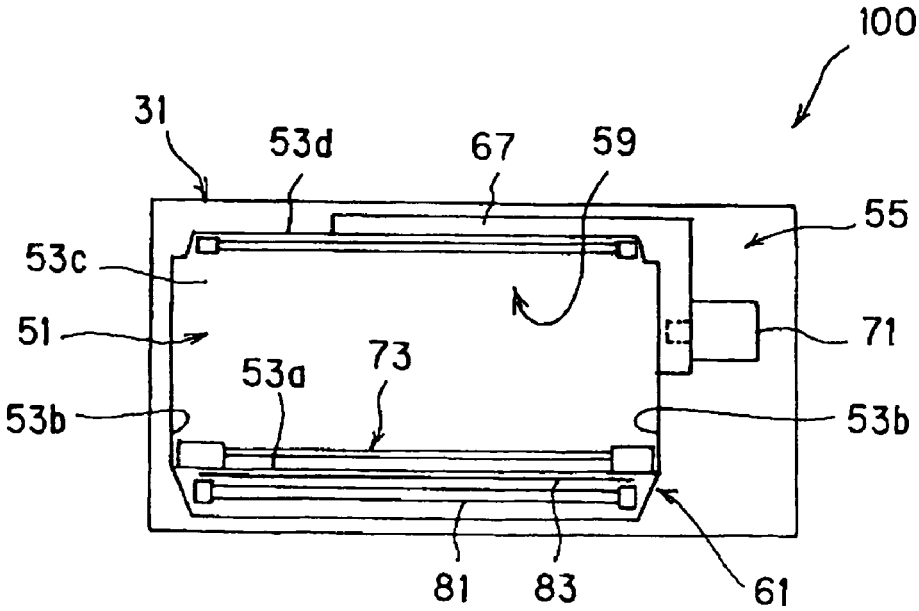
Figure 3:
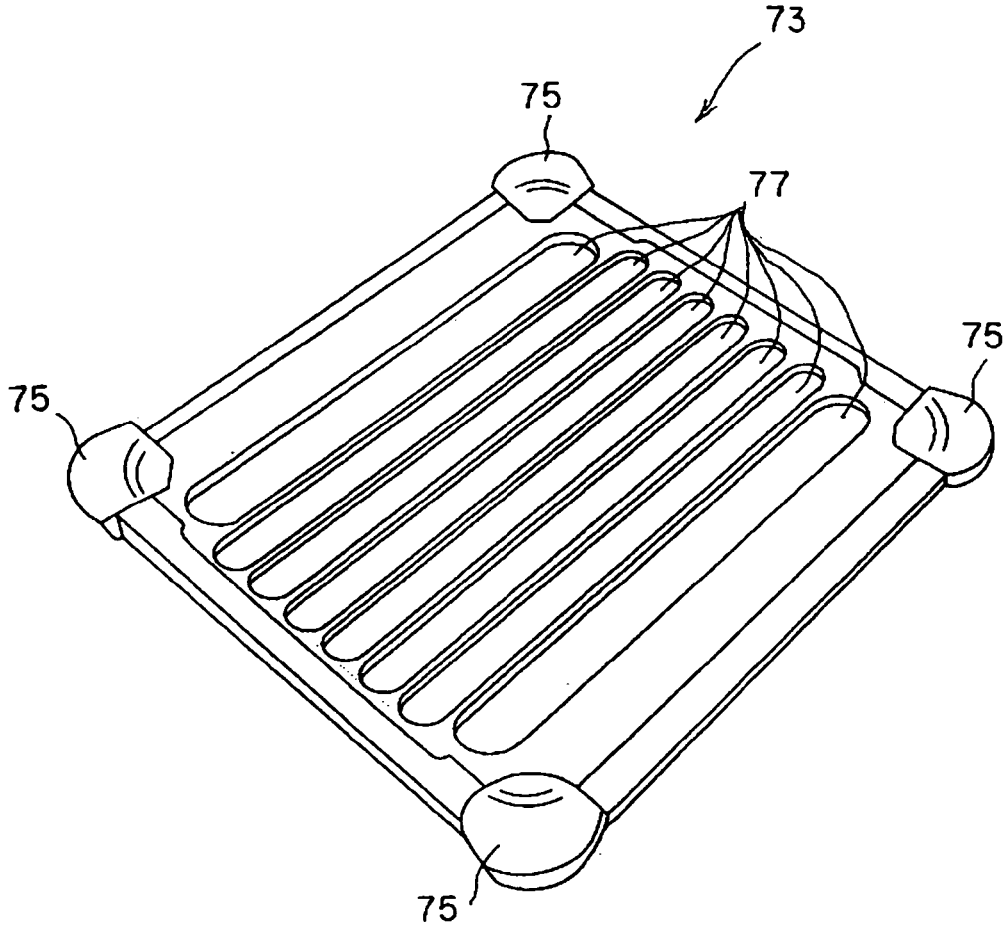
FIG. 3 is a perspective view of a mounting base.

FIG. 1 is a perspective view viewing a state of opening a door of a heating cooker according to the invention from a front side, FIG. 2 illustrates explanatory views of an inner structure by FIG. 2(*a*) taken along a line A-A of the heating cooker shown in FIG. 1 and FIG. 2(*b*) taken along a line B-B thereof, and FIG. 3 is a perspective view of a mounting base.

In the heating cooker 100 according to the embodiment, an opening portion 33 is constituted by a front face of a main body 31 formed in, for example, a shape of a parallepiped, and the opening portion is attached with a door 37 having a window 35 openably and closably via a hinge 38 (refer to FIG. 2) provided at a lower portion thereof. Opening of the door 37 is restricted by a stopper 39 substantially in a horizontal state. A locking claw 41 is projected from an inner face of the door 37, and the locking claw 41 is made to be able to lock the door 37 in a closed state by moving into a locking hole 43 provided at the main body 31. Further, a close detecting projection 45 is projected from the inner face of the door 37, and the close detecting projection 45 is moved into a detecting hole 47 provided at the main body 31 to detect a state of closing the door 37. Further, a close detecting signal is used in a safety stop control or the like of a magnetron, mentioned later.

The heating chamber 51 covered by an exterior plate 49 of the main body 31 is provided at inside of the main body 31, the heating chamber 51 is opened by the opening portion 33 and is opened and closed by the door 37. The heating chamber 51 is formed in a box-like shape opening a front face thereof by the bottom plate 53*a*, the side plate 53*b*, the rear plate 53*c*, and the ceiling plate 53*d* constituting the face members 53. As the face members 53, for example, steel plates having self cleaning layers having a self cleaning function, steel plates subjected to a fluoride coating excellent in contamination resistance at surfaces thereof or the like can preferably be used.

An electric equipment chamber 55 is provided at one end (right end) of the main body 31, and the electric equipment chamber 55 is installed with a magnetron or the like, mentioned later. An operation panel 57 is attached to a front face of the electric equipment chamber 55, and the operation panel 57 includes a display portion, not illustrated, for displaying a heating time period or the like, a selecting button, not illustrated, for selecting high frequency heating or heater heating, an input button, not illustrated, for inputting a heating condition of the heating time period or the like and so on.

As shown by FIG. 2, the main body 31 includes an upper heating portion 59 on an upper side of the heating chamber 51 and a lower heating portion 61 on a lower side of the heating chamber 51. The upper heating portion 59 comprises a heater chamber 63 formed at the ceiling plate 53*d*, the rod-like heater (quartz heater or the like) 65 provided at inside of the heater chamber 63, a wave guide 67 connected to the electric equipment chamber 55, and a wave guide hole 69 of the wave guide 67 opened at the ceiling plate 53*d*.

A section of the heater chamber 63 is formed in a trapezoidal shape and an inner face of a recessed portion thereof constitutes a reflecting plate of the rod-like heater 65. As shown by FIG. 2(*b*), the wave guide 67 is formed as a duct in an L-like shape, one end thereof is opened to the heating chamber 51 as the wave guide hole 69 and other end thereof is connected to a magnetron 71 provided at the electric equipment chamber 55. The magnetron 71 oscillates a microwave by being supplied with a drive power by a high voltage transformer, not illustrated, to emit the microwave from the waveguide hole 69 to inside of the heating chamber 51 via the waveguide 67. Further, the magnetron 71 and the like are cooled by a cooling fun, not illustrated, provided at inside of the electric equipment chamber 55 in driving the magnetron 71.

In the heating chamber 51, the mounting base 73 is placed on the bottom plate 53*a*, The mounting base 73 is formed by an area substantially the same as that of the bottom plate 53*a* and is made to be able to insert into the heating chamber 51. as shown by FIG. 3. The mounting base 73 comprises a metal plate of aluminum or the like, provided with leg portions 75 made by insulators in a cap-like shape at four corners thereof and arranged on an upper side of the bottom plate 53*a* by a predetermined interval therebetween when placed above the bottom plate 53*a*, A plurality of holes 77 in, for example, an oval shape are bored at the mounting base 73, and the hole 77 facilitates radiation heat from the ceiling plate 53*d* to pass therethrough and promotes an effect of randomly reflecting the microwave. That is, the mounting base 73 is provided with a function of a grid and a function of agitating the microwave.

Figure 4:
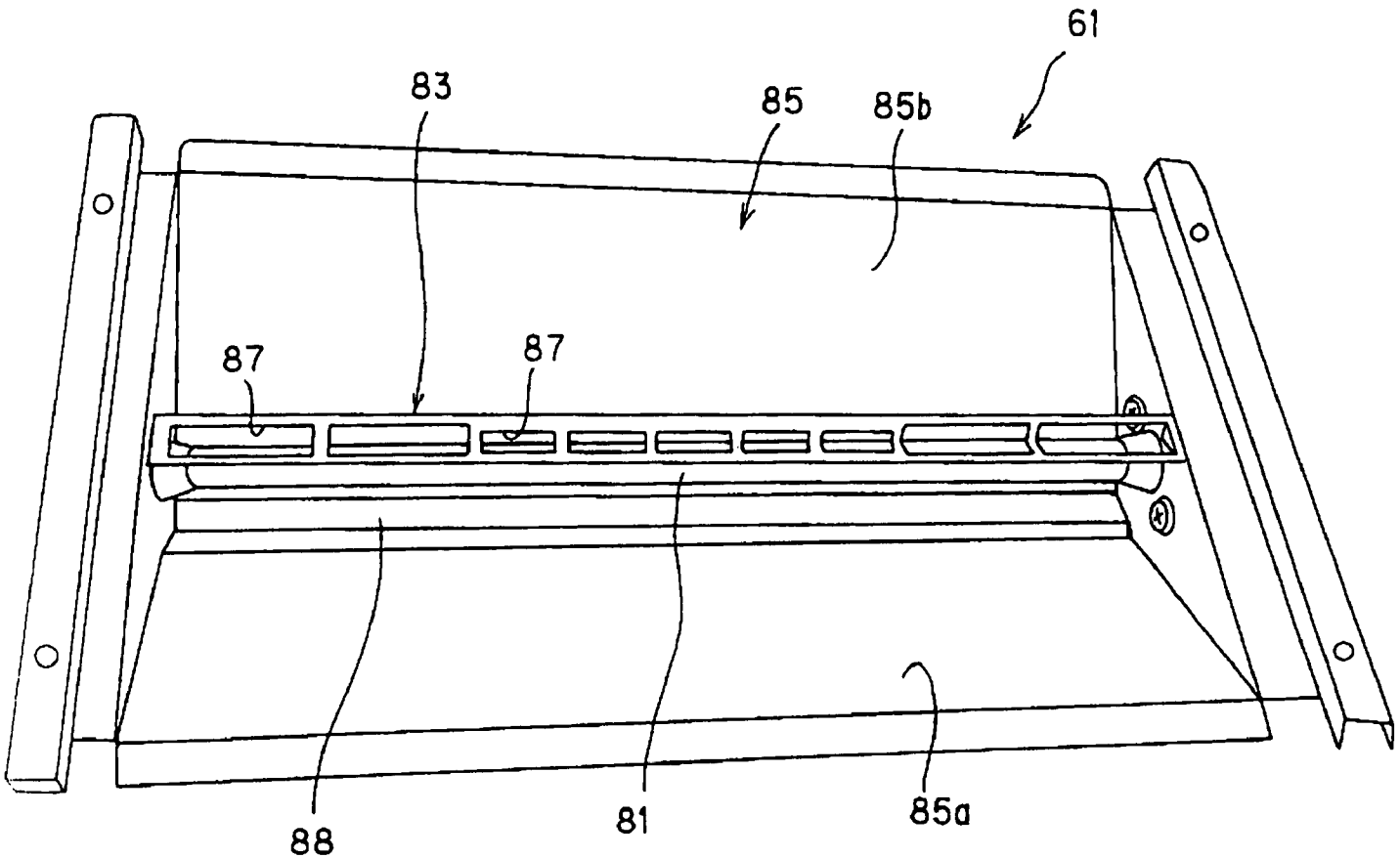
FIG. 4 is a perspective view showing a lower heating structure on a lower side of a heating chamber.
Figure 5:
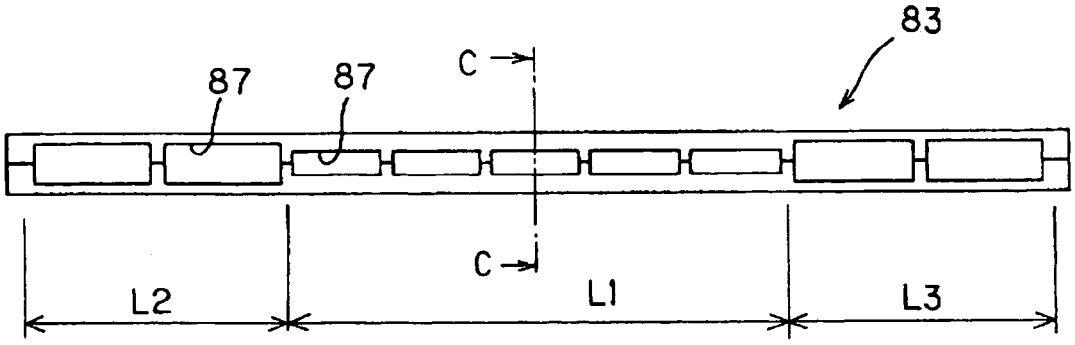
FIG. 5 is a plane view of a heat shielding member.
Figure 6:
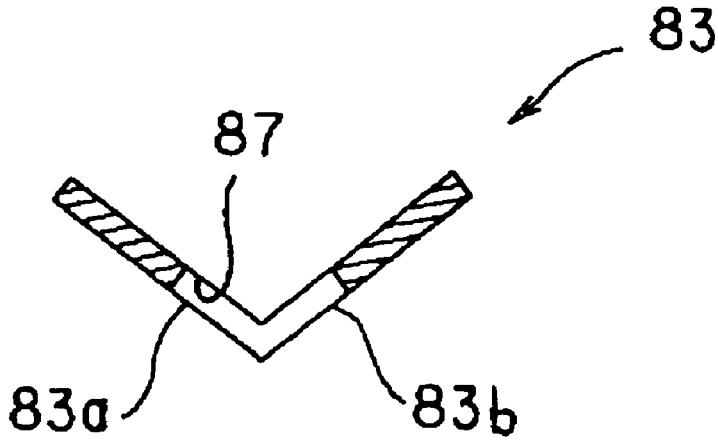
FIG. 6 is a sectional view of the heat shielding member shown in FIG. 5 taken along a line C-C thereof.

FIG. 4 is a perspective view showing the lower heating structure on a lower side of the heating chamber, FIG. 5 is a plane view of a heat shielding member, and FIG. 6 is a sectional view taken along a line C-C of the heat shielding member shown in FIG. 5.

The heating cooker 100 heats to process the object placed on the mounting base 73 of the heating chamber 51. Therefore, a uniformity of a heating temperature distribution higher than that of the upper heating portion 59 is requested to the lower heating portion 61 to which the object is proximate.

The lower heating portion 61 includes a single piece of the rod-like heater (quartz heater or the like) 81 arranged on an outer side of the heating chamber 51 and along the bottom plate (face member) 53*a*, The lower heating portion 61 is provided with the heat shielding member 83 and a reflecting plate 85 other than the bottom plate 53*a* and the rod-like heater 81. The heat shielding member 83 is formed to be slender and is provided along a longitudinal direction of the rod-like heater 81 between the rod-like heater 81 and the bottom plate 53*a*.

The heat shielding member 83 comprises a flat plate material of an aluminum plated steel plate or the like. Further, the heat shielding member 83 having a thin thickness of about 1 through 2 mm as a thickness thereof is used to reduce a heat capacitance thereof. That is, the heat capacitance of the heat shielding member 83 becomes smaller than that of the heat shielding member of the prior art comprising the round bar by being constituted by the flat plate member having the thin thickness. Thereby, heat deprived by the heat shielding member 83 per se is reduced, an effect of dispersing a larger amount of heat is achieved, and the heating temperature distribution in the depth direction of the heating chamber 51 is made to be further uniform.

Further, the heat shielding member 83 includes two parallel inclined faces 83*a* and 83*b* by constituting a section thereof in a V-like shape projected to the rod-like heater 81 by folding to bend the flat plate material by constituting a boundary by a center line in the longitudinal direction. Thereby, heat from the rod-like heater 81 is reflected in a lower direction. The heat reflected by the heat shielding member 83 is finally reflected upwardly to the bottom plate 53*a* by the reflecting plate 85. Although the section of the heat shielding member 83 is formed in the V-like shape in the embodiment, otherwise, the heat shielding member 83 may be constituted by a projected curve face of a semicircle or the like.

By constituting the section of the heat shielding member 83 arranged right above the rod-like heater 81 by the projected shape (V-like section) projected to the rod-like heater 81 in this way, a heating air flow moved up from the rod-like heater 81 is divided in two from a front end of the projected portion and distributed to a front side and a rear side in the depth direction of the heating chamber 51 to promote an effect of heating a front side of the bottom plate 53*a* and a rear side of the bottom plate 53*a*. Further, the radiation heat from the rod-like heater 81 is made to be able to be reflected to a lower front side and a lower rear side of the rod-like heater 81 by the pair of inclined faces 83*a* and 83*b* interposing the front end of the projected portion of the heat shielding member 83. Therefore, according to the constitution of providing the reflecting plate 85 having the section in the V-like shape on the lower side of the rod-like heater 81, the reflected radiation heat is further irradiated to a front side of the bottom plate 53*a* and a rear side of the bottom plate 53*a* via the reflecting plate 85 to promote an effect of heating the front side of the bottom plate 53*a* and the rear side of the bottom plate 53*a*.

Here, a heat shielding area of the heat shielding member 83 is set to be large at a center portion in a longitudinal direction of the heat shielding member 83 and to be small at an end portion in the longitudinal direction. That is, heat transferred from the rod-like heater 81 to the bottom plate 53*a* is made to be uniform in the longitudinal direction of the rod-like heater 81. Therefore, in the heating chamber 51 arranged such that the longitudinal direction of the rod-like heater 81 coincides with an opening direction (left and right direction of FIG. 1) of the opening portion 33 as in the embodiment, also the heating temperature distribution in the opening direction is made to be uniform.

Further, the heat shielding member 83 includes the opening hole 87 and the above-described heat shielding area is set by large or small of an opening area of the opening hole 87. According to the embodiment, a heat shielding area of a center portion L1 is set to be larger than end portions L2 and L3 by making the five opening holes 87 at the center portion small and making the respective two opening holes 87 at the both end sides large.

By setting the heat shielding areas by the opening holes 87 formed at the heat shielding member 83 in this way, the heat shielding area is made to be able to adjust regardless of a shape of the heat shielding area (for example, width of the heat shielding member 83). Thereby, a degree of freedom of designing the heat shielding member 83 having the reflecting function and the heat shielding function can be promoted. Further, here, large or small of the opening area includes large or small by adjusting a size of the single opening hole 87, large or small by adjusting to increase or reduce a plurality of the opening holes 87, or large or small by adjusting pitch intervals of the plurality of opening holes 87 or the like.

Further, according to the embodiment, the width of the heat shielding member 83 in a direction orthogonal to the longitudinal direction is set to be substantially equal to the diameter of the rod-like heater 81. That is, direct radiation from the center portion of the rod-like heater 81 to the bottom plate 53*a* is shielded. Thereby, the heat shielding member 83 can be formed by a minimum necessary width, which is advantageous in material cost and compact formation. Further, the width of the heat shielding member 83 is not limited thereto but as explained later in a variation of the heat shielding member 83, no problem is posed by providing an enlarged width portion larger than the diameter of the rod-like heater 81.

The section of the reflecting plate 85 is constituted by a V-like shape by an inclined plate 85*a* arranged on the front side and an inclined plate 85*b* arranged on the rear side by interposing the rod-like heater 81 at a center thereof. Further, the inclined plate 85*a* and the inclined plate 85*b* are connected by a hut-like portion 88. Also the hut-like portion 88 reflects the heat from the rod-like heater 81 to the front side and the rear side.

Figure 7:
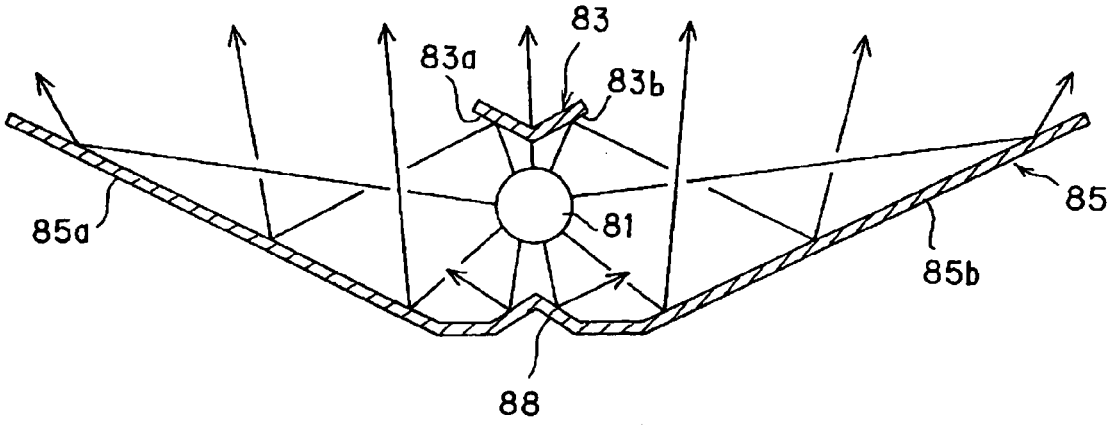
FIG. 7 is an explanatory view of operation of the lower heating structure.

FIG. 7 is an explanatory view of operation of the lower heating structure.

According to the lower heating portion 61 having such a structure, heat transferred from the rod-like heater 81 to the upper side is reflected to the lower side by the inclined faces 83*a* and the 83*b* of the heat shielding member 83 and the radiation heat reflected to the lower side is reflected to the front side and the rear side of the bottom plate 53*a* by the inclined plate 85*a* and the inclined plate 85*b*.

A portion of the heat transferred from the rod-like heater 81 to the upper side is transferred directly to the bottom plate 53*a* by passing the opening holes 87 of the heat shielding member 83. That is, the heat transferred to the center portion of the bottom plate 53*a* right above the rod-like heater 81 is pertinently restrained to prevent the bottom plate 53*a* from being heated excessively.

Further, heat transferred from the rod-like heater 81 substantially in a horizontal direction and a lower direction is directly reflected by the inclined plate 85*a* and the inclined plate 85*b* of the reflecting plate 85 to transfer to the front side and the rear side of the bottom plate 53*a*.

In this way, the heat from the rod-like heater 81 alleviates unevenness of heating in the depth direction of the heating chamber 51 by cooperating operation of the heat shielding member 83 and the reflecting plate 85.

Figure 8:
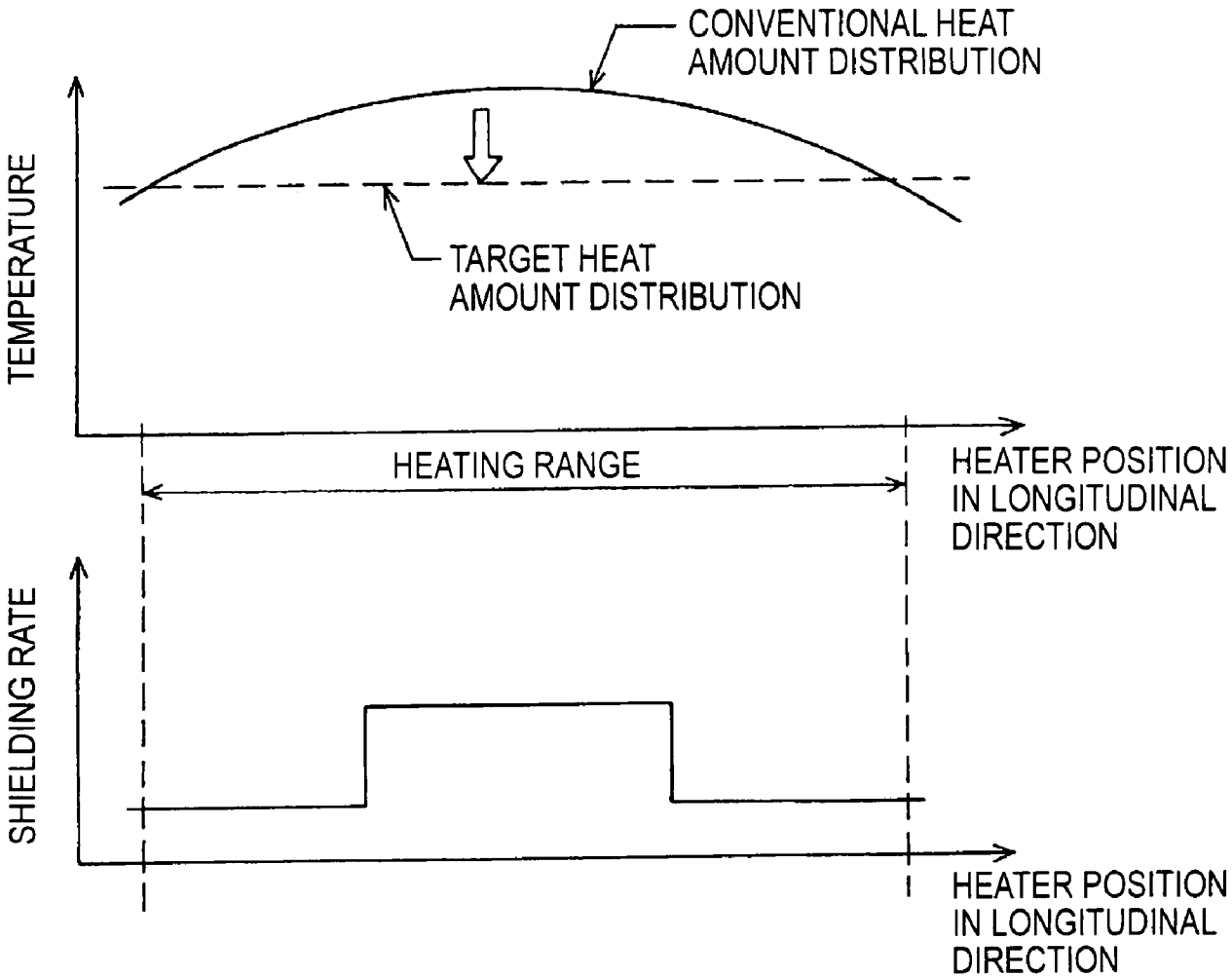
FIG. 8 illustrates explanatory diagrams showing a correlation between a shielding rate and a heat amount distribution of a rod-like heater.

FIG. 8 is an explanatory view showing a correlation between a shielding rate of the rod-like heater and a heat amount distribution.

Further, although according to the constitution of the background art which is not provided with the heat shielding member 83, a heat amount distribution shown by a bold line in FIG. 8(*a*) becomes high at a center portion in a longitudinal direction, by changing the sizes of the opening holes 87 at the center portion and the end portions in the longitudinal direction of the heat shielding member 83 as described above, the rate of shielding the heat from the rod-like heater 81 is made to be high at the center portion as shown by FIG. 8(*b*). Thereby, the heat transferred from the rod-like heater 81 to the bottom plate 53*a* is facilitated to be uniform in the longitudinal direction of the rod-like heater 81, a heating temperature distribution in the opening direction is made to be proximate to a uniform target heating amount distribution shown by a dotted line in FIG. 8(*a*) and the center portion of the object which is liable to be heated excessively in the prior art and the left end portion and the right end portion of the object which are liable to be heated insufficiently are equally heated.

Figure 9:
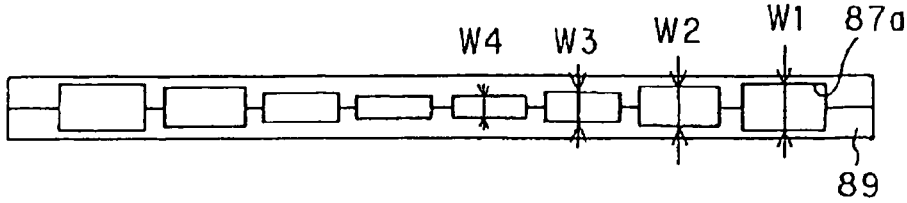
FIG. 9 illustrates explanatory views showing modified examples of the heat shielding member by FIGS. 9(*a*) through 9(*e*)
Figure 9:
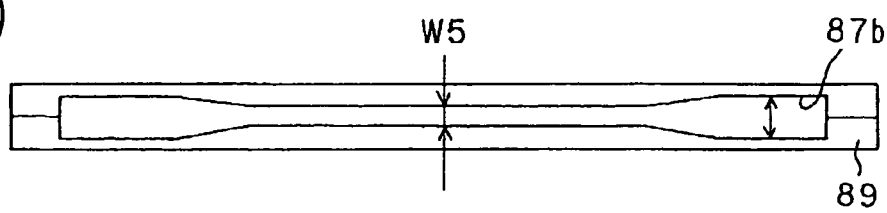
Figure 9:
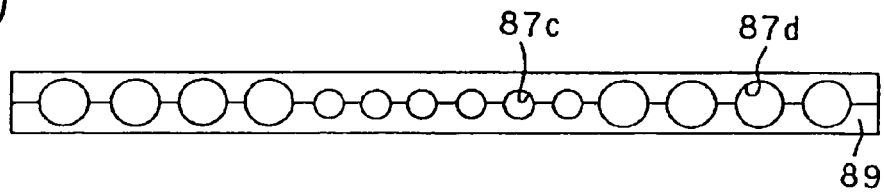
Figure 9:
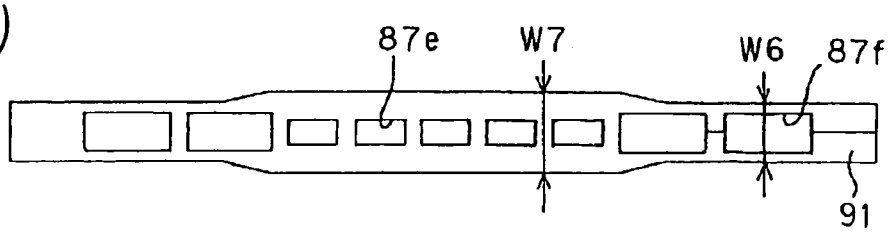
Figure 9:
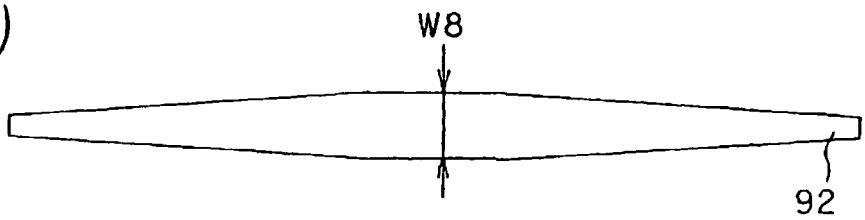

FIG. 9 illustrates explanatory views showing modified examples (variations) of the heat shielding member by FIGS. 9(*a*) through 9(*e*).

The heat shielding member 83 may be as follows other than the above-described constitution.

That is, as shown by FIG. 9(*a*), the heat shielding member 83 may be formed with opening holes 87*a* in a rectangular shape gradually reducing opening widths W1, W2, W3, W4 toward a center portion at a fold-to-bend plate 89 having a section in a V-like shape. As shown by FIG. 9(*b*), the heat shielding member 83 may be formed with a single opening hole 87*b* in a slit-like shape narrowing the width W5 at the center portion at the fold-to-bend plate 89 having the section in the V-like shape. As shown by FIG. 9(*c*), the heat shielding member 83 may be formed with opening holes 87*c* in a circular shape or the like having a small opening area at the center portion and opening holes 87*d* in a circular shape or the like having a large opening area at the both end portions at the fold-to-bend plate 89 having the section in the V-like shape. As shown by FIG. 9(*d*), the heat shielding member 83 may be formed with opening holes 87*e* in a rectangular shape having a small opening area at the center portion and opening holes 87*f* in a rectangular shape having a large opening area at the two end portions at a flat strip plate 91 a width of the center of which is enlarged to a width 7 more than a width W6 at the end portion. As shown by FIG. 9(*e*), the heat shielding member 83 may be constituted by a flat strip plate 92 setting a heat shielding area by changing a width W8 in a direction orthogonal to the longitudinal direction along the longitudinal direction without forming the opening hole 87.

Particularly, according to the heat shielding member 83 shown in FIG. 9(*e*), the heat shielding area can easily be set by pertinently changing the width W8. That is, the width dimension is set to be large at the center portion of the rod-like heater 81 intended to ensure a large shielding area and the width dimension is set to be small at the end portion of the rod-like heater 81 intended to reduce the shielding area. Thereby, the heat shielding area can be controlled by constituting the heat shielding member 83 by a simple shape.

Further, it is preferable that the width of the heat shielding member 83 in the direction orthogonal to the longitudinal direction is provided with a width substantially equal to at least the diameter of the rod-like heater 81 at the center portion in the longitudinal direction of the heat shielding member. In that case, at the center portion of the rod-like heater 81 at which heating by the rod-like heater 81 is maximized, the width of the heat shielding member 83 is equal to or larger than the diameter of the rod-like heater 81 to shield direct radiation from the center portion of the rod-like heater to the face member.

Figure 10:
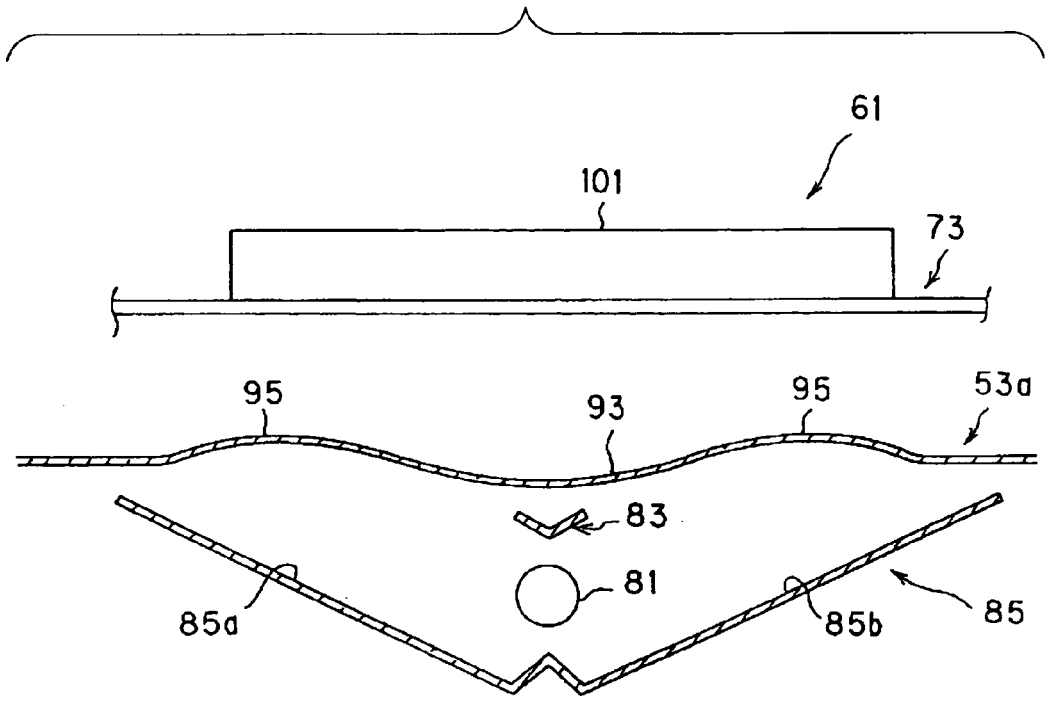
FIG. 10 is an explanatory view showing a positional relationship among the lower heating structure and a bottom plate and an object.

FIG. 10 is an explanatory view showing a positional relationship among the lower heating structure and the bottom plate and the object.

In the lower heating portion 61, the bottom plate 53*a* of the heating chamber 51 opposed to the rod-like heater 81 includes at least either of the recessed portion 93 having a section in a recessed shape or the projected portion 95 having a section in a projected shape formed substantially in parallel with the longitudinal direction of the rod-like heater 81 along therewith. According to the embodiment, the bottom plate 53*a* is provided with both of the recessed portion 93 and the projected portion 95.

By forming the recessed portion 93 and the projected portion 95 at the bottom plate 53*a* opposed to the rod-like heater 81 substantially in parallel therewith, the lower heating portion 61 achieves operation of adjusting a distance which is not achieved in the case of the flat bottom plate as in the structure of the background art. Here, the distance adjusting operation signifies operation of arranging a specific portion of the bottom plate 53*a* to be proximate to the object 101, or arranging the specific portion to be remote from the object 101 by the recessed portion 93 or the projected portion 95.

The bottom plate 53*a* includes a pair of the projected portions 95 on both sides interposing the rod-like heater 81 (front side, rear side of the heating chamber 51). The projected portion 95 is formed by a projected curve face in a semicircular cylinder shape projected to an inner portion of the heating chamber 51. The projected portions 95, 95 are made to be proximate to the object 101 at inside of the heating chamber 51 and constitute recesses at outside of the heating chamber 51. Therefore, at the inner portion of the heating chamber 51, heating of the front side and the rear side in the depth direction of the heating chamber 51 is promoted by the distance adjusting operation.

Further, the bottom plate 53*a* includes the recessed portion 93 at a portion opposed to the rod-like heater 81, that is, in the opening direction of the center portion in the depth direction. The recessed portion 93 makes the bottom plate 53*a* remote from the object 101 at inside of the heating chamber 51. Therefore, at inside of the heating chamber 51, heating of the center portion in the depth direction of the heating chamber 51 is restrained by the distance adjusting operation and as a result, transfer of heat from the rod-like heater 81 to the object 101 is reduced.

Further, a mode shown below may be used other than the above-described constitution example.

Figure 11:
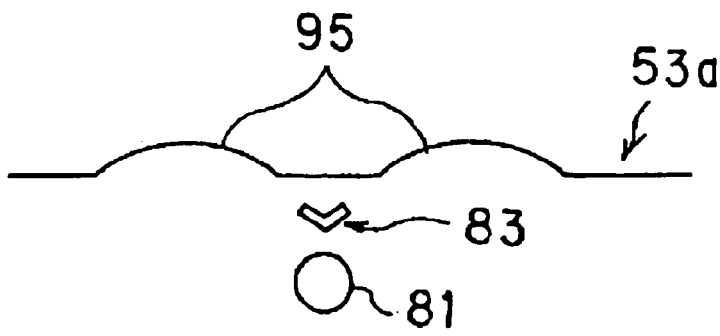
FIG. 11 illustrates explanatory views showing examples of a recessed portion and projected portions formed at a bottom plate by FIGS. 11(*a*) and 11(*b*)
Figure 11:
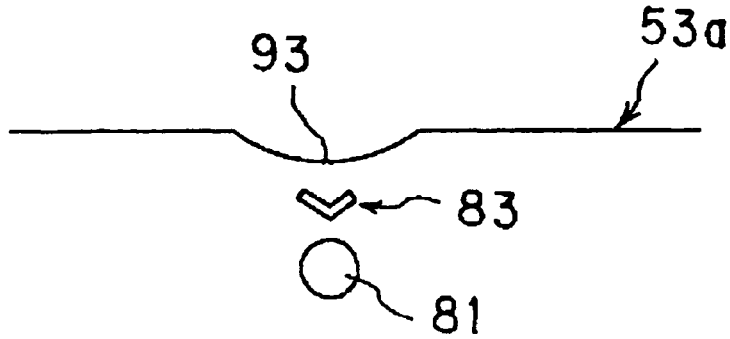
Figure 12:
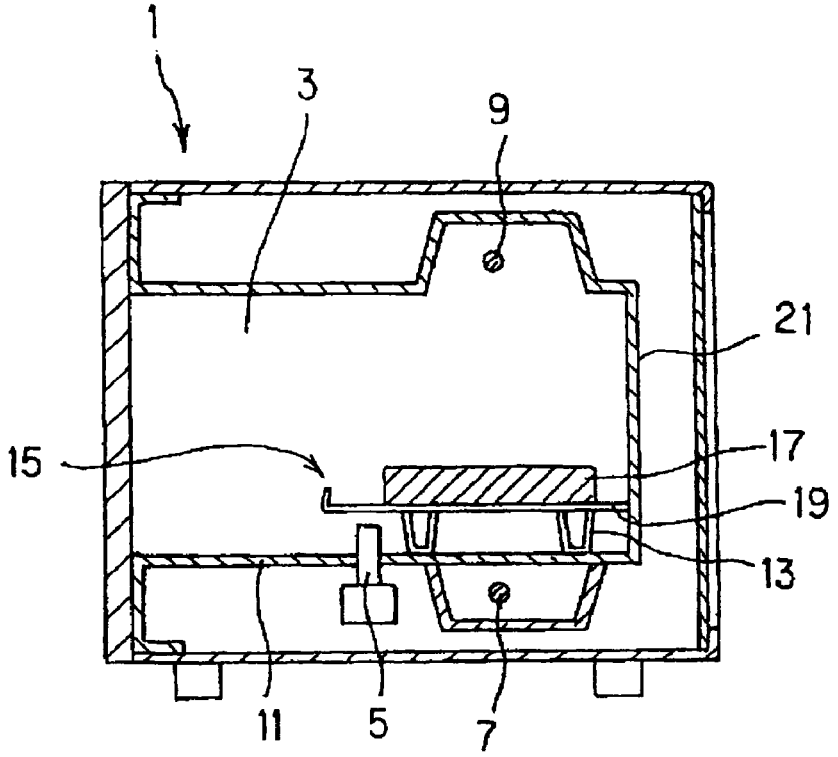
FIG. 12 PRIOR ART
FIG. 12 is a vertical sectional view of a heating cooker of a background art.

FIG. 11 illustrates explanatory views showing examples of a recessed portion and projected portions formed at the bottom plate by FIGS. 11(*a*) and 11(*b*).

The lower heating portion 61 achieves the above-described respective operation and effect by providing only a pair of the projected portions 95, 95 at the bottom plate 53*a* as shown by FIG. 11(*a*), or providing only the recessed portion 93 at the bottom plate 53*a* as shown by FIG. 11(*b*).

Next, an explanation will be given of a method of using the heating cooker 100 constituted in this way.

In the above-described constitution, when the object 101 is heated by high frequency heating, first, the door 37 is opened and the object 101 is mounted on the mounting base 73. Further, after closing the door 37, by operating the input button of the operation panel 57, the heating condition of the heating time period or the like is inputted while confirming the heating condition at the display portion. Successively, by operating a heating start button, heating is started. Thereby, the magnetron 71 is driven, the microwave is irradiated to the object 101 and heating cooking is carried out. After a predetermined time period has elapsed, the magnetron 71 is stopped from being driven to finish the heating cooking. Simultaneously therewith, cooking finishing alarm is emitted and a user is informed of finishing of the heating cooking.

Meanwhile, in the case of heating cooking by the rod-like heaters 65 and 81, first, the door 37 is opened and, for example toast which is the object 101 is mounted on the mounting base 73. Successively, after closing the door 37, toast cooking is selected by operating the input button of the operation panel 57 and the cooking start button is operated. Thereby, toast cooking is started, electricity is continuously conducted to the rod-like heaters 65 and 81, after a predetermined heating cooking time period has elapsed, electricity is stopped from being conducted to the rod-like heaters 65 and 81 and the heating cooking is finished. Simultaneously therewith, the cooking finish alarm is emitted and the user is informed of finishing of the heating cooking.

According to the heating cooker 100, heat transferred from the rod-like heater 81 to a portion proximate to the bottom plate 53*a* can pertinently be restrained by the heat shielding member 83 on the outer side of the heating chamber 51 and the bottom plate 53*a* can uniformly be heated. That is, according to the heating cooker 100, the bottom plate 53*a* is temporarily heated by heat of the rod-like heater 81 and the object 101 is secondarily heated by the heated bottom plate 53*a*, Therefore, in the heating chamber 51 in which the rod-like heater 81 is arranged such that the longitudinal direction coincides with the opening direction, the heating temperature distribution in the depth direction is made to be uniform, the center portion of the object 101 which is liable to be heated excessively and the front end portion and the rear end portion of the object 101 which are liable to be heated insufficiently in the background art are equally heated.

Further, although in the above-described embodiment, an explanation has been given of an example of the case in which a turn table mechanism is not provided, the heating cooker 100 may be provided with a turn table mechanism comprising a turn table, a table rotating motor and the like. By providing the turn table to the heating cooker 100, even when concentrated heating is assumedly carried out, since the position of the object 101 is changed, further uniform heating can be carried out. With regard to high frequency heating, the embodiment is not limited to the turn table mechanism but may be constructed by a constitution of agitating a radio wave by a stirrer blade.

Further, although according to the above-described embodiment, an explanation has been given by taking an example of the case in which the rod-like heaters 65 and 81 are disposed on lower sides of the ceiling plate 53*d* and the bottom plate 53*a*, the position of installing the rod-like heaters 65 and 81 are not limited thereto but otherwise, the rod-like heaters 65 and 81 may be provided at the side plate 53*b* or the rear plate 53*c*.

Further, although according to the above-described embodiment, an explanation has been given by taking an example of the case of providing the heat shielding member 83 and the reflecting plate 85 only at the rod-like heater 81 on the lower side, the heat shielding member 83 and the reflecting plate 85 may be provided to the rod-like heater 65 on the upper side, and also in this case, the effect of making the heating amount distribution of the heating chamber 51 effectively uniform is achieved by the above-described distance adjusting operation or the like.

Although an explanation has been given of the invention in details and in reference to the specific embodiment, it is apparent for the skilled person that the invention can variously be changed or modified without deviating the spirit and the range of the invention.

The application is based on Japanese Patent Application No. 2003-028390 filed on Feb. 5, 2003 and content thereof is incorporated here by reference.

INDUSTRIAL APPLICABILITY

As has been explained in details, according to the heating cooker of the invention, at least a single piece of the rod-like heater arranged along the face member forming the heating chamber and the heat shielding member provided along the longitudinal direction of the rod-like heater between the rod-like heater and the face member are provided on the outer side of the heating chamber and therefore, heat transferred from the rod-like heater to the portion proximate to the face member can pertinently be restrained by the heat shielding member and the face member can uniformly be heated. Further, in the heating chamber arranged with the rod-like heater such that the longitudinal direction of the rod-like member coincides with the opening direction, the heating temperature distribution in the depth direction is made to be uniform and the center portion of the object which is liable to be heated excessively and the front end portion and the rear end portion of the object which are liable to be heated insufficiently in the background art are equally heated. As a result, in the heating cooker interposing the face member between the object and the rod-like heater, the uniform baking mark can be produced at the total of the object at inexpensive cost by the single piece of the rod-like heater.

The invention claimed is:

1. A heating cooker for heating to process an object placed on a mounting base at inside of a heating chamber, said heating cooker comprising:

at least a single piece of a rod-like heater arranged along a face member, the face member forming the heating chamber and the rod-like heater being provided on an outer side of the heating chamber; and a heat shielding member provided along a longitudinal direction of the rod-like heater between the rod-like heater and the face member, wherein the face member of the heating chamber opposed to the rod-like heater is provided with at least either one of a recessed portion having a section in a recessed shape or a projected portion having a section in a projected shape formed substantially in parallel with the longitudinal direction of the rod-like heater along therewith.

2. The heating cooker according to claim 1, wherein the heat shielding member comprises a flat plate material.

3. The heating cooker according to claim 2, wherein the heat shielding member is constituted by folding to bend the flat plate material and is provided with a V-shaped section projecting to the rod-like heater.

4. The heating cooker according to any one of claim 1 through claim 3, wherein a heat shielding area of the heat shielding member is set to be large at a center portion in a longitudinal direction of the heat shielding member and to be small at an end portion in the longitudinal direction.

5. The heating cooker according to claim 4, wherein the heat shielding member includes an opening hole and the heat shielding area is controlled through an opening area of the opening hole.

6. The heating cooker according to claim 4, wherein a width of the heat shielding member in a direction orthogonal to the longitudinal direction is changed along the longitudinal direction to thereby set the heat shielding area.

7. The heating cooker according to claim 6, wherein the width of the heat shielding member in the direction orthogonal to the longitudinal direction is provided with a width substantially equal to at least a diameter of the rod-like heater.

8. The heating cooker according to claim 1, wherein the face member of the heating chamber includes a pair of the projected portions on both sides interposing the rod-like heater.

9. The heating cooker according to claim 1 or claim 8, wherein the face member of the heating chamber includes the recessed portion opposed to the rod-like heater.

10. A heating cooker for heating to process an object placed on a mounting base at inside of a heating chamber, said heating cooker comprising:

at least a single piece of a rod-like heater arranged along a face member, the face member forming the heating chamber and the rod-like heater being provided on an outer side of the heating chamber; and a heat shielding member provided along a longitudinal direction of the rod-like heater between the rod-like heater and the face member, wherein the heat shielding member comprises a flat plate material, is constituted by folding to bend the flat plate material and is provided with a V-shaped section projecting to the rod-like heater.

11. The heating cooker according to claim 10, wherein a heat shielding area of the heat shielding member is set to be large at a center portion in a longitudinal direction of the heat shielding member and to be small at an end portion in the longitudinal direction.

12. The heating cooker according to claim 11, wherein the heat shielding member includes an opening hole and the heat shielding area is controlled through an opening area of the opening hole.

13. The heating cooker according to claim 11, wherein a width of the heat shielding member in a direction orthogonal to the longitudinal direction is changed along the longitudinal direction to thereby set the heat shielding area.

14. The heating cooker according to claim 13, wherein the width of the heat shielding member in the direction orthogonal to the longitudinal direction is provided with a width substantially equal to at least a diameter of the rod-like heater.

15. The heating cooker according to claim 10, wherein the face member of the heating chamber opposed to the rod-like heater is provided with at least either one of a recessed portion having a section in a recessed shape or a projected portion having a section in a projected shape formed substantially in parallel with the longitudinal direction of the rod-like heater along therewith.

16. The heating cooker according to claim 15, wherein the face member of the heating chamber includes a pair of the projected portions on both sides interposing the rod-like heater.

17. The heating cooker according to claim 15 or claim 16, wherein the face member of the heating chamber includes the recessed portion opposed to the rod-like heater.

* * * * *